US007970323B2

(12) United States Patent
Katoh et al.

(10) Patent No.: US 7,970,323 B2
(45) Date of Patent: Jun. 28, 2011

(54) DEVELOPING DEVICE, DEVELOPER THEREFOR, AND IMAGE FORMING METHOD AND APPARATUS, AND PROCESS CARTRIDGE USING THE DEVELOPING DEVICE

(75) Inventors: Hiroaki Katoh, Nagaokakyo (JP); Masayuki Hagi, Minoo (JP); Yoshihiro Mikuriya, Nishinomiya (JP); Hideaki Yasunaga, Ibaraki (JP); Yoshitaka Sekiguchi, Nishinomiya (JP); Kazuoki Fuwa, Toyonaka (JP); Masahide Inoue, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 558 days.

(21) Appl. No.: 12/042,730

(22) Filed: Mar. 5, 2008

(65) Prior Publication Data

US 2008/0304875 A1 Dec. 11, 2008

(30) Foreign Application Priority Data

Mar. 19, 2007 (JP) ..... 2007-071534

(51) Int. Cl.
*G03G 15/08* (2006.01)

(52) U.S. Cl. ..... 399/281; 399/258; 399/284; 399/285

(58) Field of Classification Search ..... 399/258, 399/281, 284
See application file for complete search history.

(56) References Cited

U.S. PATENT DOCUMENTS 6,560,430 B2 * 5/2003 Muto et al. ..... 399/255
7,058,344 B2 * 6/2006 Mizutani et al. ..... 399/281
7,346,301 B2 * 3/2008 Hashimoto et al. ..... 399/284
2003/0108808 A1 * 6/2003 Inoue et al. ..... 430/108.8
2003/0231906 A1 * 12/2003 Yoshizawa ..... 399/281
2005/0033198 A1 * 2/2005 Kehyayan et al. ..... 600/586
2005/0158061 A1 * 7/2005 Do ..... 399/44
2006/0204882 A1 9/2006 Nozaki et al.
2006/0210902 A1 9/2006 Nakamura et al.

(Continued)

FOREIGN PATENT DOCUMENTS

JP 2-79863 3/1990

(Continued)

OTHER PUBLICATIONS

Jul. 15, 2010 Japanese official action (and partial English translation enclosed) in connection with counterpart Japanese patent application.

*Primary Examiner* — David M Gray
*Assistant Examiner* — Francis Gray
(74) *Attorney, Agent, or Firm* — Cooper & Dunham LLP

(57) ABSTRACT

A developing device including a developer bearing member configured to feed a developer to an image bearing member; a developer supplying member, which is contacted with the developer bearing member at a first nip while opposed thereto and which is configured to supply the developer to the developer bearing member; and a developer layer forming member, which is contacted with the developer bearing member at a second nip located on the downstream side from the first nip relative to the rotation direction of the developer bearing member to form the layer of the developer on the developer bearing member, wherein the developer is a nonmagnetic one component developer, and the distance between the front edge of the second nip and the rear edge of the first nip relative to the rotation direction of the image bearing member is greater than 0.8 mm and less than 2.0 mm.

15 Claims, 4 Drawing Sheets

U.S. PATENT DOCUMENTS

| | | | | |
|---|---|---|---|---|
| 2006/0275686 | A1 | 12/2006 | Kadota et al. | |
| 2006/0292474 | A1 | 12/2006 | Mikuriya et al. | |
| 2007/0026335 | A1 | 2/2007 | Yamamoto et al. | |
| 2007/0059625 | A1 | 3/2007 | Yamamoto et al. | |
| 2007/0122729 | A1 | 5/2007 | Katoh et al. | |
| 2007/0148568 | A1 | 6/2007 | Kadota et al. | |
| 2007/0177907 | A1* | 8/2007 | Hashimoto et al. | 399/284 |
| 2007/0189812 | A1* | 8/2007 | Murayama et al. | 399/258 |
| 2007/0190443 | A1 | 8/2007 | Hagi et al. | |
| 2007/0207399 | A1 | 9/2007 | Kadota et al. | |
| 2007/0212630 | A1 | 9/2007 | Yasunaga et al. | |
| 2007/0217842 | A1 | 9/2007 | Kato et al. | |
| 2007/0238042 | A1* | 10/2007 | Yasunaga et al. | 430/108.1 |
| 2008/0038656 | A1 | 2/2008 | Yasunaga et al. | |
| 2008/0070149 | A1* | 3/2008 | Kato et al. | 430/111.4 |

FOREIGN PATENT DOCUMENTS

| | | |
|---|---|---|
| JP | 7-36213 | 2/1995 |
| JP | 7-181809 | 7/1995 |
| JP | 8-141509 | 6/1996 |
| JP | 11-305552 | 11/1999 |
| JP | 2002-6622 | 1/2002 |
| JP | 2003-84563 | 3/2003 |
| JP | 2003-107905 | 4/2003 |
| JP | 2003-122045 | 4/2003 |
| JP | 2003-131414 | 5/2003 |
| JP | 2004-38198 | 2/2004 |
| JP | 2004-219507 | 8/2004 |

* cited by examiner

DEVELOPING DEVICE, DEVELOPER THEREFOR, AND IMAGE FORMING METHOD AND APPARATUS, AND PROCESS CARTRIDGE USING THE DEVELOPING DEVICE

BACKGROUND OF THE INVENTION

1. Technical Field

This disclosure relates to a developing device for developing an electrostatic image with a one component developer (i.e., a toner). In addition, this disclosure also relates to a one component developer for the developing device, and an image forming method, an image forming apparatus and a process cartridge using the developing device.

2. Discussion of the Related Art

Recently, a need exists for a low end laser beam printer which is low-cost and compact and which can perform high speed printing. In order to miniaturize a laser beam printer, it is essential to use a fixing device, which does not use an oil application device configured to apply an oil to the fixing member thereof and which uses two rollers (such as combinations of a fixing roller (heat roller) and a pressure roller) for fixing toner images. In this case, since an oil application device is not used, it is essential to include a release agent (such as waxes) in the toner used for the developing device. However, toner including a release agent therein has large adhesiveness and cohesiveness, and therefore the torque has to be increased to well agitate the toner (or the developer) in the developing device.

In addition, in order to perform high speed image formation, it is preferable to use a tandem image forming apparatus in which four image forming units each including a photoreceptor, a developing device, and other devices are serially arranged. In such a tandem image forming apparatus, the four image forming units are arranged in a horizontal direction to prevent increase in height of the image forming apparatus. Therefore, it is necessary to use a vertical developing device for such image forming units.

When a vertical developing device is used, all the weight of the toner in the container of the developing device is applied to the developing roller, and therefore the toner tends to stay around a developer layer forming blade, which scrapes the toner to form a thin layer of the toner on the developing roller. In this case, a toner adhesion problem in that the toner is adhered to the developer layer forming blade, resulting in formation of low density images or uneven density images occurs. Alternatively, an uneven density image problem in that when images with high image area proportion are formed, the resultant images have uneven image density because the toner cannot be well supplied to the photoreceptor occurs.

In attempting to prevent occurrence of such problems, a technique in that a polymerization toner which has a spherical form and has a relatively weak adhesiveness is used, and a technique in that a release agent is included in a polymerization toner have been proposed. However, the techniques have the following drawbacks:

(1) The toners have high costs because expensive materials have to be used for the reaction of forming the binder resin of the toner;

(2) The costs of the facilities for producing such polymerization toners are high because, for example, a facility for removing and collecting volatile materials is necessary; and (3) Since a large amount of water is used for manufacturing such polymerization toners, severe location requirements are set for manufacturing the toners.

Therefore, it is hard to use such toners for low end laser beam printers.

Published unexamined Japanese patent application No. 2003-084563 discloses a toner layer forming member which is formed of a plate, wherein the plate is bent at two portions of the tip thereof such that the ridge lines of the bending portions are parallel to each other and the ridge lines are present on the opposite sides of the plate.

However, even when such a toner layer forming member is used for a low end printer, it is hard to use a polymerization toner (which has a spherical form) for the low end printer.

Because of these reasons, a need exists for a vertical developing device which does not cause the toner adhesion problem and uneven density image problem.

SUMMARY

As one aspect of the present application, a developing device is provided which includes:

a developer bearing member configured to feed a developer to an image bearing member while rotating and bearing a layer of the developer thereon to develop an electrostatic image on the image bearing member therewith;

a developer supplying member, which is contacted with the developer bearing member at a first nip while opposed thereto and which rotates to supply the developer to the developer bearing member;

a developer layer forming member, which is contacted with the developer bearing member at a second nip located on a downstream side from the first nip relative to the rotation direction of the developer bearing member to form the layer of the developer on the developer bearing member; and a developer supplying mechanism located over the developer supplying member and the developer bearing member to supply the developer to the developer supplying member.

The developer is a nonmagnetic one component developer (i.e., a nonmagnetic toner), and the following relationship is satisfied:

$$0.8\ \text{mm} < |a-b| < 2.0\ \text{mm},$$

wherein a represents the front edge of the second nip relative to the rotation direction of the developer bearing member and b represents the rear edge of the first nip relative to the rotation direction, and $|a-b|$ represents the distance between the front edge of the second edge and the rear edge of the first nip relative to the rotation direction of the developer bearing member.

The developing is preferably a vertical developing device. In addition, it is preferable that the developer preferably includes a binder resin, a wax, a colorant, and an external additive, and the wax is contained in the binder resin.

As another aspect of the present application, a developer is provided which is preferably used for the above-mentioned developing device. Specifically, the developer is a nonmagnetic toner having a volume average particle diameter of from 6 μm to 10 μm, and a fluidity property such that when a cone-shaped rotor is entered into a layer of the toner at a depth of 5 mm or more, the torque produced by the toner is from 1.0 mNm to 2.5 mNm, wherein the toner layer has a space ratio of 58%.

As yet another aspect of the present application, an image forming method is provided which includes:

supplying a nonmagnetic one component developer to a developer bearing member with a developer supplying member, wherein the developer supplying member is contacted with the developer bearing member at a first nip;

forming a layer of the nonmagnetic one component developer on the developer bearing member with a developer layer forming member, wherein the developer layer forming member is contacted with the developer bearing member at a second nip;

developing an electrostatic image on an image bearing member with the developer layer formed on the developer bearing member to form a toner image on the image bearing member, wherein the developer includes a binder resin, a wax, a colorant, and an external additive, and wherein the following relationship is satisfied:

$$0.8\ \text{mm} < |a-b| < 2.0\ \text{mm},$$

wherein |a−b| represents the distance between the front edge of the second edge and the rear edge of the first nip relative to the rotation direction of the developer bearing member.

As a further aspect of this disclosure, an image forming apparatus is provided which includes:

an image bearing member configured to bear an electrostatic image;

the developing device mentioned above, which develops the electrostatic image to form a toner image on the image bearing member;

a transfer device configured to transfer the toner image to a receiving material optionally via an intermediate transfer medium; and a fixing device configured to fix the toner image on the receiving material while sandwiching the toner image with a heating member (such as heat rollers) and a pressing member (such as pressure rollers).

It is preferable that the fixing device does not use an oil applicator configured to apply an oil to the heating member.

As a still further aspect of this disclosure, a process cartridge is provided which includes:

an image bearing member configured to bear an electrostatic image; and the developing device mentioned above, which develops the electrostatic image to form a toner image on the image bearing member, wherein the process cartridge is detachably attached to an image bearing member as a unit.

The aforementioned and other aspects, features and advantages will become apparent upon consideration of the following description of the preferred embodiments taken in conjunction with the accompanying drawings.

DESCRIPTION OF THE PREFERRED EMBODIMENTS

Figure 1:
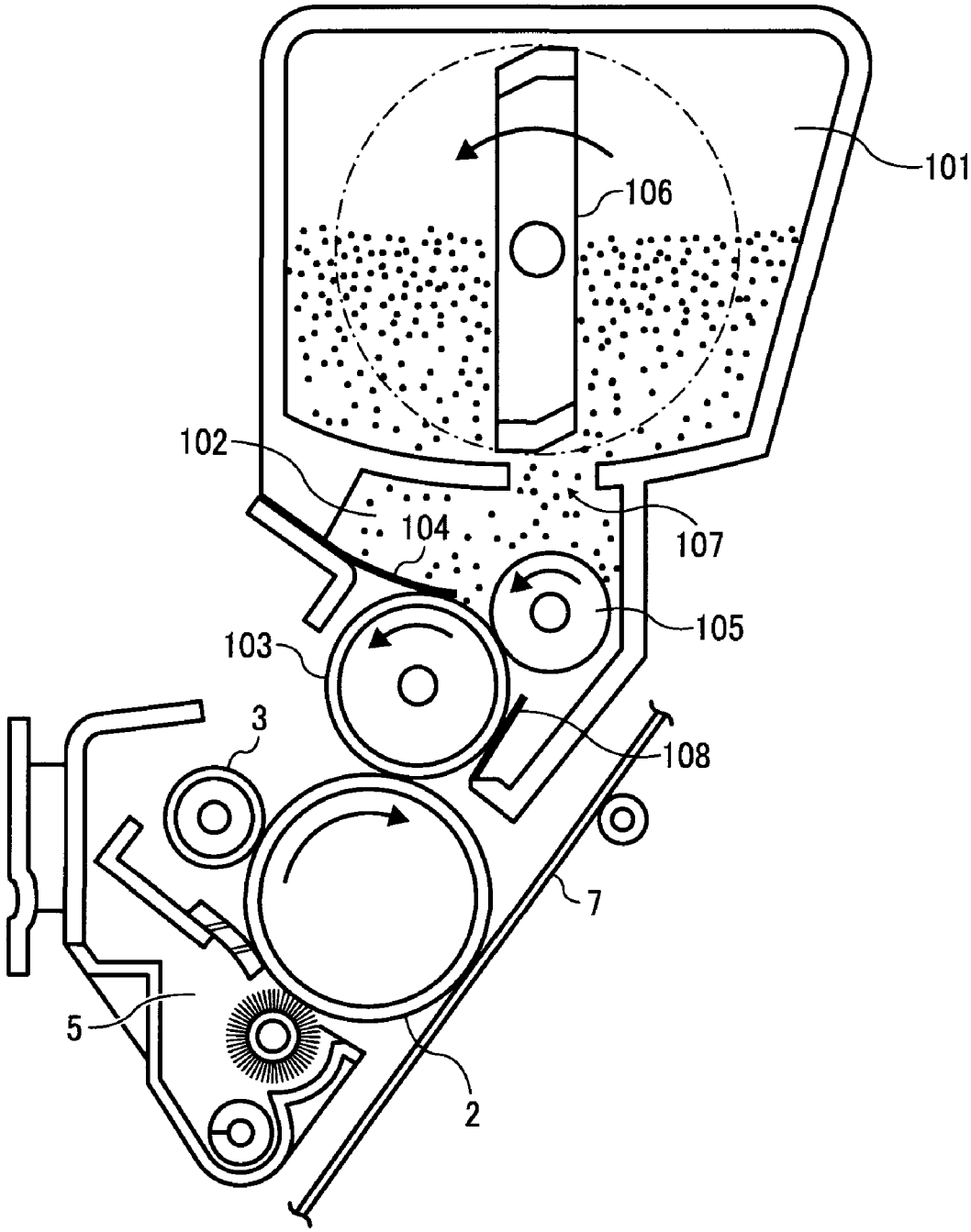
FIG. 1 is a schematic view illustrating an example of the developing device of the present invention, and an example of the process cartridge of the present invention.

At first, the toner of the present invention will be explained.

The toner of the present invention includes toner particles including at least a binder resin, a wax, and a colorant; and an external additive.

The wax is preferably contained in the binder resin. In this case, bleeding of the wax can be prevented, and thereby a problem in that the bled wax or the toner on which the bled wax is present is adhered to image forming members (such as developer bearing members, developer layer forming members and image forming members), resulting in formation of abnormal images can be avoided. The wax is included in the toner to impart good releasability to the toner when toner images are fixed with a heating member.

More preferably, the toner of the present invention includes toner particles including a first binder resin containing a hydrocarbon wax therein, a second binder resin, a colorant, and a charge controlling agent, and an external additive.

Next, the toner constituents will be explained in detail.

Binder Resin

The binder resin (the first and second binder resins) included in the toner for use in the developing device of the present invention is not particularly limited, and any known resins which can be used for conventional full color toners can be used therefor. Specific examples of the resins include polyester resins, (meth)acrylic resins, styrene—(meth) acrylic copolymers, epoxy resins, cyclic olefin resins (e.g., TOPAS-COC (from Ticona)), etc. Among these resins, polyester resins are preferably used for the first and second binder resins because the resultant toner can be preferably used for oil-less fixing.

Suitable polyester resins for use as the binder resin of the toner include polyester resins which are prepared by subjecting a polyhydric alcohol and a polycarboxylic acid to a polycondensation reaction.

Specific examples of the dihydric alcohols for use as the polyhydric alcohol include alkylene oxide adducts of bisphenol A such as polyoxypropylene(2.2)-2,2-bis(4-hydroxyphenyl)propane, polyoxypropylene(3.3)-2,2-bis(4-hydroxyphenyl)propane, polyoxypropylene(6)-2,2-bis(4-hydroxyphenyl)propane, and polyoxypropylene(2.0)-2,2-bis(4-hydroxyphenyl)propane; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polytetramethylene glycol, bisphenol A, hydrogenated bisphenol A, etc.

Specific examples of the tri- or more-hydric alcohols for use as the polyhydric alcohol include sorbitol, 1,2,3,6-hexanetetrol, 1,4-sorbitane, pentaerythritol, dipentaerythritol, tripentaerythritol, 1,2,4-butanetriol, 1,2,5-pentanetriol, glycerol, 2-methylpropane triol, 2-methyl-1,2,4-butanetriol, trimethylol ethane, trimethylol propane, 1,3,5-trihydroxymethyl benzene, etc.

Specific examples of the dicarboxylic acids for use as the polycarboxylic acid include maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, n-dodecenylsuccinic acid, iso-dodecenylsuccinic acid, n-dodecylsuccinic acid, iso-dodecylsuccinic acid, n-octenylsuccinic acid, iso-octenylsuccinic acid, n-octylsuccinic acid, isooctylsuccinic acid, anhydrides or low alkyl esters of these acids, etc.

Specific examples of the tri- or more-carboxylic acids for use as the polycarboxylic acid include 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxy-2-methyl-2-methylenecarboxypropane, 1,2,4-cyclohexanetricarboxylic acid, tetra(methylenecarboxy)methane, 1,2,7,8-octanetetracarboxylic acid, pyromellitic acid, trimer acids of embole, anhydrides or low alkyl esters of these acids, etc.

In addition, vinyl-polyester resins, which are prepared by mixing monomers of a polyester resin, one or more monomers of a vinyl resin, and one or more monomers which are reactive with both the monomers of the polyester resin and the monomers of the vinyl resin, and subjecting the monomers to a polycondensation reaction (to prepare the polyester resin) and a radical polymerization reaction (to prepare the vinyl resin) at the same time, can also be used as polyester resins. The monomers which are reactive with both the monomers of the polyester resin and the monomers of the vinyl resin are monomers which can be used for both a polycondensation reaction and a radical polymerization reaction, i.e., monomers which have both a carboxyl group which can cause a polycondensation reaction and a vinyl group which can cause a radical polymerization reaction. Specific examples of such monomers include fumaric acid, maleic acid, acrylic acid, methacrylic acid, etc.

Specific examples of the monomers for use in preparing the polyester component of such vinyl-polyester resins include the polyhydric alcohols and polycarboxylic acids mentioned above. Specific examples of the monomers for use in preparing the vinyl resin component of the vinyl-polyester resins include styrene and derivatives thereof such as styrene, o-methylstyrene, m-methylstyrene, p-methylstyrene, α-methylstyrene, p-ethylstyrene, 2,4-dimethylstyrene, p-tert-butylstyrene, and p-chlorostyrene; ethylene-type unsaturated monoolefins such as ethylene, propylene, butylene, and isobutylene; alkyl esters of methacrylic acid such as methyl methacrylate, n-propyl methacrylate, isopropyl methacrylate, n-butyl methacrylate, isobutyl methacrylate, t-butyl methacrylate, n-pentyl methacrylate, isopentyl methacrylate, neopentyl methacrylate, 3-(methyl)butyl methacrylate, hexyl methacrylate, octyl methacrylate, nonyl methacrylate, decyl methacrylate, undecyl methacrylate, and dodecyl methacrylate; alkyl esters of acrylic acid such as methyl acrylate, n-propyl acrylate, isopropyl acrylate, n-butyl acrylate, isobutyl acrylate, t-butyl acrylate, n-pentyl acrylate, isopentyl acrylate, neopentyl acrylate, 3-(methyl)butyl acrylate, hexyl acrylate, octyl acrylate, nonyl acrylate, decyl acrylate, undecyl acrylate, and dodecyl acrylate; unsaturated carboxylic acids such as acrylic acid, methacrylic acid, itaconic acid, and maleic acid; acrylonitrile, esters of maleic acid, esters of itaconic acid, vinyl chloride, vinyl acetate, vinyl benzoate, vinyl methyl ketone, vinyl ethyl ketone, vinyl hexyl ketone, vinyl methyl ether, vinyl ethyl ether, and vinyl isobutyl ether.

Specific examples of the polymerization initiators for use in polymerizing the vinyl monomers include azo-type or diazo-type initiators such as 2,2'-azobis(2,4-dimethylvaleronitrile), 2,2'-azobisisobutylonitirile, 1,1'-azobis(cyclohexane-1-carbonitrile), and 2,2'-azobis-4-methoxy-2,4-dimethylvaleronitrile; and peroxide-type initiators such as benzoyl peroxide, dicumyl peroxide, methyl ethyl ketone peroxide, isopropyl peroxy carbonate, and lauroyl peroxide.

The above-mentioned polyester resins are preferably used as the binder resin (the first and second binder resins) of the toner of the present invention. In order that the toner can be used for oil-less fixing methods, the toner preferably has a good combination of releasability and offset resistance. In order to impart a good combination of releasability and offset resistance to the toner, a combination of a first binder resin and a second binder resin is preferably used for the binder resin.

Suitable resins for use as the first binder resin include polyester resins which are prepared by subjecting a polyhydric alcohol and a polycarboxylic acid to a polycondensation reaction, and preferably polyester resins which are prepared by subjecting an alkylene oxide adduct of bisphenol A (serving as a polyhydric alcohol) and terephthalic acid or fumaric acid (serving as a polycarboxylic acid) to a polycondensation reaction.

Suitable resins for use as the second binder resin include vinyl-polyester resins, and preferably vinyl-polyester resins which are prepared by using an alkylene oxide adduct of bisphenol A, terephthalic acid, trimellitic acid and succinic acid as the monomers for forming a polyester resin component; styrene and butyl acrylate as the monomers for forming a vinyl resin component; and fumaric acid as the monomer for use in both the polycondensation reaction and radical polymerization reaction.

When the first binder resin is synthesized, it is preferable to add a hydrocarbon wax such that the resin includes the wax therein. Specifically, a hydrocarbon wax can be internally added to the first binder resin by polymerizing a mixture of monomers for constituting the first binder resin and the hydrocarbon wax. More specifically, a mixture of an acid monomer, an alcohol monomer and a hydrocarbon wax is subjected to a polycondensation reaction. When the first binder resin is a vinyl-polyester resin, for example, the following method is preferably used:

(1) a mixture of monomers for constituting a polyester resin component and a hydrocarbon wax is heated while agitated to perform a polycondensation reaction; and (2) one or more monomers for constituting a vinyl resin component are dropped into the mixture to perform a radical polymerization reaction.

Wax

In general, waxes having a low polarity have good releasability from heating members (such as heat rollers). Therefore, hydrocarbon waxes having a low polarity are preferably used for the toner of the present invention. In the present application, hydrocarbon waxes are defined as waxes constituted of carbon atoms and hydrogen atoms, which do not include a group such as ester groups, alcohol groups and amide groups. Specific examples of the hydrocarbon waxes include polyolefin waxes such as polyethylene, polypropylene, and ethylene—propylene copolymers; petroleum waxes such as paraffin waxes and microcrystalline waxes; synthetic waxes such as FISCHER TROPSCH WAXES; etc. Among these hydrocarbon waxes, polyethylene waxes, paraffin waxes, and FISCHER TROPSCH WAXES are preferably used, and polyethylene waxes and paraffin waxes are more preferably used.

The wax is preferably include in the toner of the present invention in an amount of from 3 parts to 10 parts by weight per 100 parts by weight of the toner. The wax is preferably included in the binder resin.

Dispersant for Wax

The toner of the present invention can optionally include a dispersant for wax. The dispersant is not particularly limited, and any known materials used for the dispersant for wax can be used.

Specific examples of the materials for use as the dispersant for wax include block or graft copolymers and co-oligomers, which include therein both a unit having a good solubility in waxes and another unit having a good solubility in resins, wherein the units are present as block units or one of the units is grafted to the other unit; copolymers of an unsaturated hydrocarbon such as ethylene, propylene, butane, styrene and α-styrene with an α- or β-unsaturated carboxylic acid or an ester or an anhydride thereof such as acrylic acid, methacrylic acid, maleic acid, maleic anhydride, itaconic acid, and itaconic anhydride; block or graft copolymers of a vinyl resin with a polyester resin; etc.

Specific examples of the units having a good solubility in waxes include hydrocarbon groups having not less than 12 carbon atoms, hydrocarbon resin groups such as polyethylene groups, polypropylene groups, polybutene groups and polybutadiene groups, and copolymer groups including a hydrocarbon resin group.

Specific examples of the units having a good solubility in resins include polyester resin groups and vinyl resin groups.

Charge Controlling Agent

Known charge controlling agents for use in conventional toners can be used for the toner for use in the present invention.

Specific examples of the charge controlling agents include Nigrosine dyes, triphenyl methane dyes, chromium-containing metal complex dyes, molybdic acid chelate pigments, Rhodamine dyes, alkoxyamines, quaternary ammonium salts, fluorine-modified quaternary ammonium salts, alkylamides, phosphor and its compounds, tungsten and its compounds, fluorine-containing activators, metal salts of salicylic acid, metal salts of salicylic acid derivatives, etc. These materials can be used alone or in combination.

Specific examples of the marketed charge controlling agents include BONTRON 03 (Nigrosine dye), BONTRON P-51 (quaternary ammonium salt), BONTRON S-34 (metal-containing azo dye), BONTRON E-82 (metal complex of oxynaphthoic acid), BONTRON E-84 (metal complex of salicylic acid), and BONTRON E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and COPY CHARGE NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments, and polymers having a functional group such as a sulfonic acid group, a carboxyl group, a quaternary ammonium group, etc.

Among these materials, materials which can impart negative charges are preferably used for the toner of the present invention.

The content of the charge controlling agent in the toner is determined depending on the variables such as choice of binder resin, presence of additives, and dispersion method. In general, the content of the charge controlling agent is preferably from 0.1 to 10 parts by weight, and more preferably from 0.2 to 5 parts by weight, per 100 parts by weight of the binder resin included in the toner. When the content is too high, the toner has an excessive amount of charge, and thereby the electrostatic attraction between the developing roller and the toner is seriously increased, resulting in deterioration of fluidity and decrease of image density.

Colorants

The toner of the present invention includes a colorant. Suitable materials for use as the colorant include known dyes and pigments.

Specific examples of the dyes and pigments include carbon black, Nigrosine dyes, black iron oxide, NAPHTHOL YELLOW S, HANSA YELLOW 10G, HANSA YELLOW 5G, HANSA YELLOW G, Cadmium Yellow, yellow iron oxide, loess, chrome yellow, Titan Yellow, polyazo yellow, Oil Yellow, HANSA YELLOW GR, HANSA YELLOW A, HANSA YELLOW RN, HANSA YELLOW R, PIGMENT YELLOW L, BENZIDINE YELLOW G, BENZIDINE YELLOW GR, PERMANENT YELLOW NCG, VULCAN FAST YELLOW 5G, VULCAN FAST YELLOW R, Tartrazine Lake, Quinoline Yellow LAKE, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED F2R, PERMANENT RED F4R, PERMANENT RED FRL, PERMANENT RED FRLL, PERMANENT RED F4RH, Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE RS, INDANTHRENE BLUE BC, Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The content of the colorant in the toner is preferably from 1% to 15% by weight, and more preferably from 3% to 10% by weight based on the weight of the toner.

Master batches, which are complexes of a colorant with a resin (binder resin), can be used as the colorant of the toner of the present invention.

Specific examples of the resins for use as the binder resin of the master batches include the polyester resins and vinyl resins mentioned above for use in the binder resin; and other resins such as rosin, modified rosins, terpene resins, aliphatic or alicyclic hydrocarbon resins, aromatic petroleum resins, chlorinated paraffin, paraffin waxes, etc. These resins are used alone or in combination.

External Additive

The toner of the present invention includes an external additive to improve the fluidity, chargeability, developability, and/or transferability thereof.

Inorganic fine particles are typically used as the external additive. Particularly, inorganic particulate materials having an average primary particle diameter of from 10 nm to 50 nm are preferably used. When the primary particle diameter is too small, the external additive tends to be embedded into the toner particles, and thereby the image qualities are deteriorated, resulting in shortening of the life of the toner. In contrast, when the primary particle diameter is too large, the external additive tends to release from the toner particles, resulting in occurrence of a filming problem in that the toner particles are adhered to image bearing members (such as photoreceptors), and thereby image qualities are deteriorated.

The surface area of the inorganic particulate materials is preferably from 30 $m^2/g$ to 300 $m^2/g$ when measured by a BET method.

Specific examples of such inorganic particulate materials include silica, zinc oxide, tin oxide, quartz sand, titanium oxide, clay, mica, sand-lime, diatom earth, chromium oxide, cerium oxide, red iron oxide, antimony trioxide, magnesium oxide, aluminum oxide, zirconium oxide, barium sulfate, barium carbonate, calcium carbonate, silicon carbide, silicon nitride, etc.

The external additive is preferably included in the toner in an amount of from 2.5 parts to 4.0 parts by weight per 100 parts by weight of the toner.

In the toner of the present invention, the external additive preferably include a silica, which is adhered to the toner at an adhesiveness of from 30% to 80%. The method for determining the adhesiveness will be mentioned later.

The toner of the present invention preferably has a volume average particle diameter of from 5 μm to 12 μm, and more preferably from 6 μm to 10 μm when the volume average particle diameter is measured with an instrument, MULTISIZER II from Beckman Coulter Inc. The method for determining the volume average particle diameter will be mentioned later.

Next, the developing device and process cartridge of the present invention will be explained.

Figure 2:
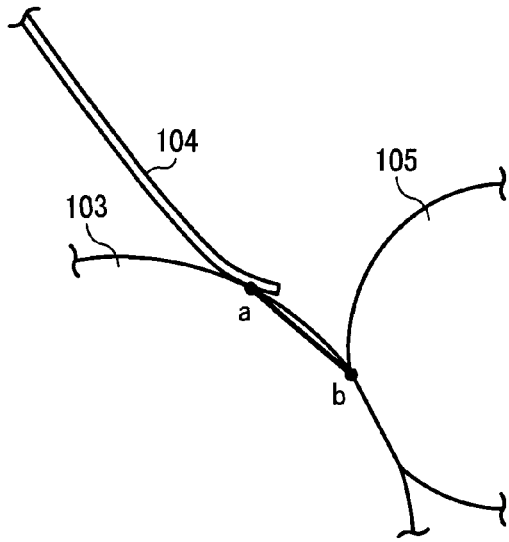
FIG. 2 is an enlarged view illustrating the developer bearing member, developer layer forming member and developer supplying member of the developing device illustrated in FIG. 1.

FIG. 1 is a schematic view illustrating the cross section of an example of the developing device and process cartridge of the present invention. FIG. 2 is an enlarged view illustrating a developing roller, a developer layer forming member, and a developer supplying roller of the developing device.

Referring to FIG. 1, the developing device includes a developer containing room 101 containing the above-mentioned toner serving as a one component developer and a developer supplying room 102, which is located below the developer containing room 101 and which supplies the developer. Below the developer supplying room 102, a developing roller 103, a developer layer forming member 104, which is contacted with the surface of the developing roller 103, and a developer supplying roller 105 are arranged. The developing roller 103 is set so as to contact a photoreceptor drum 2, and a predetermined developing bias is applied thereto by a high voltage power source (not shown).

In the developer containing room 101, a developer agitator 106, which is counterclockwise rotated, is provided. In this regard, the developer containing room 101, the developer supplying room 102, and the developer agitator 106 serve as a developer supplying mechanism. The developer agitator 106 has a rotating blade extending in the longitudinal direction (i.e., the axial direction) of the agitator and having a configuration such that the tip portions of the blade have a large surface area except for the tip portions which pass near an opening 107 of the developer containing room 101 to well agitate the developer in the developer containing room 101. Namely, the tip portions of the blade, which pass near the opening 107 have a smaller surface area so as not to feed an excess amount of developer to the developer supplying room 102 through the opening 107.

The developer near the opening 107 is agitated by the blade of the developer agitator 106 so as not to form aggregated particles, and therefore the developer falls due to its weight to the developer supplying room 102 through the opening 107. The surface of the developer supplying roller 105 is made of a foamed material having cells thereon so that the developer supplying roller 105 can well bear the developer thereon and in addition the pressure applied to the developer on the developer supplying roller 105 by the developing roller 103 is decreased to prevent deterioration of the developer.

The foamed material used for the surface portion of the developer supplying roller 105 preferably has a resistance of from $10^3$ to $10^{14}\Omega$ because a bias is applied to the developer supplying roller 105. Specifically, by applying such a bias to the developer supplying roller 105, the developer, which is present on the developer supplying roller 105 and which has been preliminarily charged at a nip between the developer supplying roller 105 and the developing roller 103, is forwarded toward the developing roller 103. The polarity of the bias applied to the developer supplying roller 105 is not particularly limited, and the polarity may be the same as or opposite to that of the charge of the developer. Alternatively, it is possible not to apply a bias to the developer supplying roller 105.

The developer supplying roller 105 is counterclockwise rotated like the developing roller 103 and supplies the toner thereon to the surface of the developing roller 103. The developing roller 103 has an elastic rubber layer, and an outermost layer which is located on the elastic rubber layer and which is made of a material which can be easily charged so as to have a charge with a polarity opposite to that of the charged developer. The elastic rubber layer preferably has a JIS-A hardness of not greater than 50 degree so that the developing roller 103 can be evenly contacted with the photoreceptor drum 2. In addition, the elastic rubber layer preferably has an electric resistance of from $10^3$ to $10^{10}\Omega$ so that the developing bias can be efficiently applied thereto.

The surface of the developing roller 103 preferably has an Arithmetical Mean Deviation of the Profile (Ra) of from 0.2 to 2.0 μm so that a proper amount of developer is borne on the surface of the developing roller 103.

The developing roller 103 is counterclockwise rotated to feed the developer thereon to the developer layer forming member 104 and the nip between the developing roller 103 and the photoreceptor drum 2.

The developer layer forming member 104 is a plate spring made of a metal such as SUS304CSP, SUS301CSP, and phosphor bronze. As illustrated in FIG. 2, the tip portion near the free end portion of the developer layer forming member 104 is contacted with the surface of the developing roller 103. In this regard, the linear pressure applied to the member 104 is from 10 N/m to 100 N/m. The particles of the developer passing through the nip between the developer layer forming member 104 and the developing roller 103 form a thin developer layer while being frictionally charged by the developer layer forming member 104. In addition, a bias, whose polarity is the same as that of the charge of the developer, may be applied to the developer layer forming member 104 to accelerate frictional charging of the developer.

The photoreceptor drum 2 is clockwise rotated. Therefore, the photoreceptor drum 2 and the developing roller 103 move in the same direction at the nip therebetween. The thin developer layer formed on the surface of the developing roller 103 is fed to the nip due to the rotation of the developing roller 103. The particles of the developer borne on the surface of the developing roller 103 are moved to an electrostatic latent image formed on the surface of the photoreceptor drum 2 due to the electric field formed by the electrostatic latent image and the developing bias applied to the developing roller 103, resulting in formation of a toner image on the surface of the photoreceptor drum 2. The particles of the developer remaining on the surface of the developing roller 103 without being used for developing the electrostatic latent image is returned to the developer supplying room 102. A seal 108 is provided along the surface of the developing roller 103 so that the developer in the developer supplying room 102 does not leak from the developing device.

Referring to FIG. 1, the process cartridge includes a charging member 3 for charging the surface of the photoreceptor 2. The thus charged photoreceptor is then exposed to imagewise light emitted from a light irradiating device (not shown) to form an electrostatic latent image on the photoreceptor 2. The electrostatic latent image is developed with the developer (i.e., toner) on the developing roller 103, resulting in formation of a toner image on the photoreceptor 2. The toner image is then transferred to a receiving material 7. The surface of the photoreceptor 2 is then cleaned with a cleaner 5 such as combinations of a brush and a blade.

The charging member 3 (hereinafter referred to as a charging roller) has a cylindrical form, and includes a metal shaft, an electroconductive layer formed thereon, and an outermost layer formed on the electroconductive layer. A voltage is applied to the metal shaft, and the voltage is applied to the photoreceptor 2 through the electroconductive layer and the outermost layer, resulting in charging of the surface of the photoreceptor 2. The metal shaft of the charging roller extends so as to be parallel to the photoreceptor drum 2. The charging roller 3 is pressed at a predetermined pressure toward the photoreceptor 2, and thereby a nip with a predetermined width is formed therebetween.

Since the photoreceptor 2 is rotated while driven by a driving device (not shown), the charging roller 3 is also rotated while driven by the photoreceptor 2. The photoreceptor 2 is charged through a region near the nip between the charging roller 3 and the photoreceptor. Since the charging roller 3 is evenly contacted with the surface of the charging area of the photoreceptor 2, the surface of the charging area is evenly charged. In this regard, the width of the charging area is the same as the length of the charging roller.

The electroconductive layer of the charging roller 3 is made of a non-metal material. In order that the charging roller is well contacted with the photoreceptor, the non-metal material preferably has a low hardness. Specific examples of such non-metal materials include polyurethane resins, polyether resins, polyvinyl alcohol resins, hydrin rubbers, EPDMs (ethylene-propylene-diene-methylene), NBRs (acrylonitrile-butadiene rubbers), etc. Specific examples of the electroconductive materials to be included in the non-metal materials include carbon black, graphite, titanium oxide, zinc oxide, etc.

The outermost layer is preferably made of a material having a medium resistance of from $10^2\Omega$ to $10^{10}\Omega$. Specific examples thereof include nylon resins, polyamide resins, polyimide resins, polyurethane resins, silicone resins, fluorine-containing resins, polyacetylene, polypyrrole, polythiophene, polycarbonate, vinyl resins, etc. It is preferable that the outermost layer has a high contact angle against water. Therefore, fluorine-containing resins are preferably used.

Specific examples of the fluorine-containing resins include polyvinylidene fluoride, polytetrafluoroethylene, vinilidene fluoride—tetrafluoro ethylene copolymers, vinilidene fluoride—tetrafluoro ethylene—hexafluoro propylene copolymers, etc. In order to control the resistance, an electroconductive material such as carbon black, graphite, titanium oxide, zinc oxide, tin oxide, and iron oxide is added thereto.

Referring to FIG. 2, character a denotes the front edge of the nip (i.e., second nip) between the developer layer forming member 104 and the developing roller 103 relative to the rotation direction of the developing roller and character b denotes the rear edge of the nip (i.e., first nip) between the developer supplying roller 105 and the developing roller 103 relative to the rotation direction of the developing roller. As mentioned above, the direct distance |a−b| between the front edge of the second nip and the rear edge of the first nip is greater than 0.8 mm and less than 2.0 mm. When the distance is too long, the toner (developer) tends to stay near the developer layer forming member 104 without being fluidized, resulting in occurrence of the toner adhesion problem and uneven density image problem. In contrast, when the distance is too short, the toner does not stay near the developer layer forming member 104. However, a large amount of toner passes through the second nip between the developer layer forming member 104 and the developing roller 103 because the developer supplying roller 104 is closer to the developer layer forming member 104, resulting in formation of another uneven density image problem which is caused by passage of a large amount of toner.

The developer layer forming member is preferably a blade and the distance between the front edge of the second nip and the tip (free end) of the developer layer forming member is from 0.1 mm to 2 mm. In addition, the tip (free end) of the developer layer forming member preferably extends toward the first nip as illustrated in FIG. 2.

Figure 6:
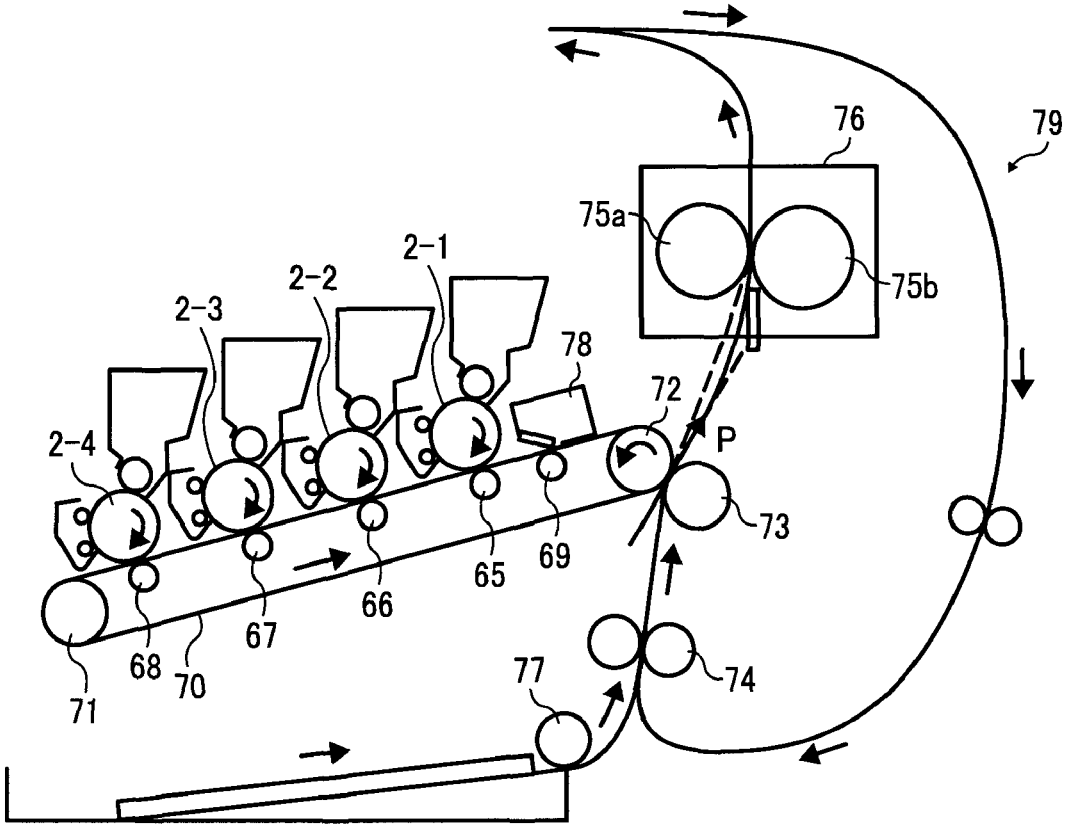
FIG. 6 is a schematic view illustrating the main portion of an example of the image forming apparatus of the present invention.

FIG. 6 is a schematic view illustrating an example of the image forming apparatus of the present invention, which can perform double-sided image formation. Referring to FIG. 6, four photoreceptors 2-1, 2-2, 2-3 and 2-4 bear thereon different color images (such as yellow, magenta, cyan and black images) constituted of respective color developers (i.e., toners). The image forming apparatus includes an image forming unit including the photoreceptors 2 form different color toner images on the photoreceptors 2; and a transfer device including an intermediate transfer belt 70, which serves as an intermediate transfer medium and which is rotated while tightly stretched by a belt driving roller 71 and a secondary transfer opposing roller 72, four primary transfer rollers 65, 66, 67 and 68, to each of which a predetermined voltage (i.e., a primary transfer bias) is applied, and a secondary transfer roller 73, to which a predetermined voltage (i.e., a secondary transfer bias) is applied. The color toner images on the photoreceptors 2 are transferred onto the intermediate transfer belt 70 so as to be overlaid thereon.

The secondary transfer roller 73 presses a sheet of a receiving material P, which has been fed from a tray by a feeding roller 77 and a pair of registration rollers 74, toward the secondary transfer opposing roller 72 to form a secondary transfer nip while applying the secondary transfer bias thereto. Therefore, the color toner images are transferred to the receiving material sheet P at the secondary transfer nip. The receiving material sheet P bearing the color toner images thereon is fed to a fixing device 76. In the fixing device 76, a heat roller 75*a* serving as a heating member, and a pressure roller 75*b* serving as a pressing member apply heat and pressure to the receiving material sheet P to fix the color toner images thereon. When single-sided image formation is performed, the receiving material sheet P bearing a fixed toner image thereon is discharged from the image forming apparatus. A cleaner 78 removes and collects toner particles remaining on the surface of the intermediate transfer belt 70 without being transferred to the receiving material sheet P. Numeral 69 denotes a backup roller of the cleaner 78.

When double-sided image formation is performed, the receiving material sheet P fed from the fixing device 76 is switched back through a passage 79 to be fed again to the secondary transfer nip, at which a second toner image is transferred, and the fixing device by which the second toner image is fixed thereon.

It is preferable that the fixing device 76 is a two-roller fixing device and an oil-less two-roller fixing device.

Next, the methods for evaluating the developer (toner) of the present invention will be explained.

1. Fluidity

Figure 3:
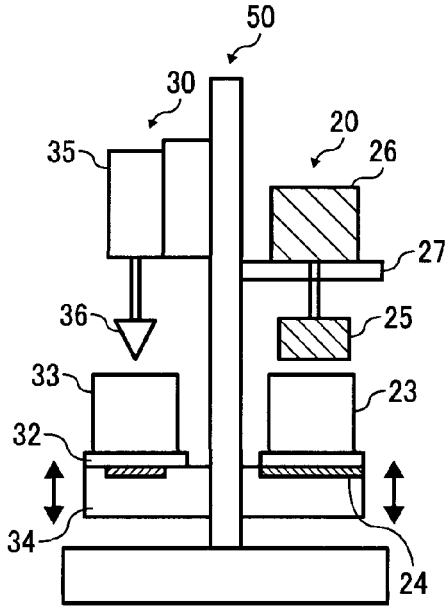
FIG. 3 is a schematic view illustrating an instrument for use in determining the torque of toner.

In the present application, the fluidity of toner is measured using an instrument having such a configuration as illustrated in FIG. 3.

FIG. 3 illustrates an example of the instrument for measuring the torque (i.e., fluidity) of toner.

Referring to FIG. 3, an instrument 50 includes a pressing zone 20 and a measuring zone 30. The pressing zone 20 includes a piston 25 configured to press the toner in a container 23, a weight 26 configured to press the piston 25, a first elevating stage 24, etc. The configuration of the pressing zone is not limited thereto.

The procedure for preparing the toner layer whose torque (fluidity) is to be measured in the measuring zone is as follows. At first, a sample (toner) is fed into the container 23, and the container 23 is set on the first elevating stage 24. The container 23 is moved up with the first elevating stage 24, so that the toner in the container 23 is contacted with the piston 25. The container 23 is further moved up so that the weight 26 is separated from a support plate 27, thereby pressing the toner with the piston 25 and the weight 26. In this regard, the pressing operation is performed for a predetermined time to form a toner layer in the container 23. Next, the first elevating stage 24 is moved down so that the toner layer is separated from the piston 25.

The material constituting the piston is not particularly limited, but the surface of the piston to be contacted with the toner is preferably a smooth surface. Therefore, the material is preferably hard and stable (i.e., hardly changes its property), and has a good processability. In addition, it is necessary for the material not to charge, and therefore the material is preferably electroconductive. From this view point, metals such as stainless steel (SUS), aluminum, copper, gold and silver are preferably used. In the present application, copper is used for the piston 25.

The measuring zone 30 includes a container 33, which is the same as the container 23 and in which the toner layer is formed, a second elevating stage 34 configured to move the container 33 up and down, a load cell 32 configured to measure the load applied to the toner (i.e., container 33), and a torque meter 35 and a cone-shaped rotor 36 configured to measure the torque of the toner layer in the container 33. The rotor 36 is fixedly connected with the shaft of the torque meter 35.

When measuring the torque and the load, the second elevating stage 34 moves the container 33 up so that the rotor 36 is entered into the toner layer in the container 33 at a predetermined speed while rotated at a predetermined revolution. The direction of the rotation of the rotor 36 is not particularly limited. In this regard, the torque applied to the cone-shaped rotor 36 is measured with the torque meter 35, and the load applied to the container 33 containing the toner layer therein is measured with the load cell 32. The amount of movement of the rotor 36 is measured with a position detector (not shown).

The configuration of the measuring zone 30 is not limited thereto. For example, the combination of the torque meter 35 and the rotor 36 may be moved up and down instead of the movement of the container 33.

The space ratio of the toner layer can be determined as follows. Specifically, the weight of the toner in the container 33 is measured with the load cell 32, and the height of the toner layer in the container 33 is also measured to determine the volume of the toner layer. The space ratio of the toner layer is determined from the weight and the volume thus measured. This calculation is made with a calculator (not shown).

Figure 4A:
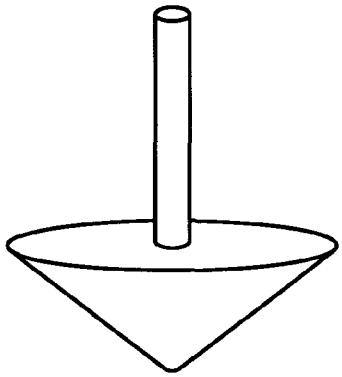
FIGS. 4A and 4B are schematic views illustrating cone-shaped rotors for use in the instrument illustrated in FIG. 3.
Figure 4B:
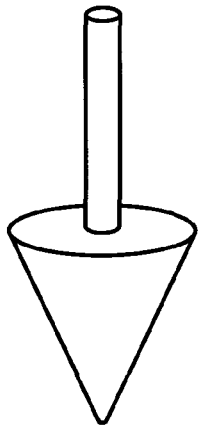

FIGS. 4A and 4B illustrates of examples of the cone-shaped rotor 36. The apex angle of the cone-shaped rotor 36 is preferably from 20 degree to 150 degree. The rotor preferably has a relatively long length such that the entire of the cone-shaped portion of the rotor is not sunk in the toner layer (i.e., the surface of the cone-shaped portion of the rotor can be observed without being covered with the toner layer).

The material constituting the containers 23 and 33 is not particularly limited, but an electroconductive material is preferably used therefor to prevent charging of the container and the sample, which seriously influences the measurement of the torque. In addition, the inner surface of the containers 23 and 33 is preferably a mirror finished surface so that the inner surface is hardly contaminated with samples. The dimension of the containers 23 and 33 is an important factor. When the containers are relatively small, the rotation of the rotor 36 is influenced by the inner surface of the containers. Therefore, it is preferable that the diameter of the containers is relatively large compared to the diameter of the rotor 36.

Figure 5:
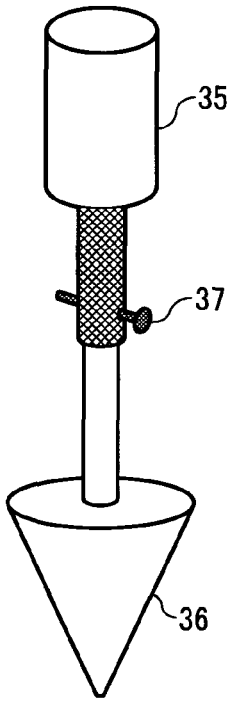
FIG. 5 is a schematic view illustrating a cone-shaped rotor attached to the instrument illustrated in FIG. 3.

FIG. 5 illustrates the cone-shaped rotor connected with the torque meter. As illustrated in FIG. 5, the cone-shaped rotor 36 is fixedly connected with the shaft of the torque meter 35 using a screw 37. Therefore, various kinds of rotors can be easily connected with the torque meter using one screw even when the rotors are made of different kinds of materials. Thus, the fluidity of toner against different kinds of materials can be easily measured.

The torque meter 35 is preferably a noncontact-type high sensitive torque meter. The load cell 32 preferably has a wide measurable load range and a wide resolution. Specific examples of the position detector include linear scales in which the detected positional information is changed to a control signal for canceling the deviance between the current position and a predetermined position, and the control signal is sent to a driving circuit of a motor of the elevator; and displacement sensors using light. The accuracy of the position detector is preferably 0.1 mm or less (better). Specific examples of the elevators for use in the elevating stages 24 and 34 include high precision elevators using a servomotor or a stepping motor.

The procedure for measuring the torque using the instrument illustrated in FIG. 3 is as follows.

(1) A sample (toner) is fed into the container 23, and the container is set on the first elevating stage 24.

(2) The first elevating stage 24 is moved up to press the toner with the piston 25 and the weight 26, resulting in formation of a toner layer in the container 23.

(3) The first elevating stage 24 is moved down so that the container 23 returns to the original position.

(4) The container 23 containing the toner layer is set on the second elevating stage 34 of the measuring zone 30. Hereinafter the container 23 serves as the container 33. Setting the container 23 on the elevating stage may be performed by rotating the elevating stage 24 so as to locate below the rotor 36.

(5) The rotor 36 is rotated and the second elevating stage 34 is moved up so that the rotating rotor 36 enters into the toner layer in the container 33 while measuring the torque or the load. In this case, the revolution and entering speed of the rotor 36 are preferably predetermined. The rotation direction of the rotor is not particularly limited.

(6) When the rotor 36 reaches a predetermined position, the elevating operation of the second elevating stage 34 is stopped to measure the torque or the load. The depth at which the portion of the rotor 36 enters into the toner layer is as long as possible (the distance between the tip (summit) of the cone-shaped portion of the rotor and the upper surface of the toner layer is preferably 5 mm or more) so that the data of torque have good reproducibility.

(7) The elevating table is moved down so that the rotor 36 is pulled out of the toner layer.

(8) When the rotor 36 is separated from the surface of the toner layer, the elevating operation of the second elevating stage 34 is stopped and the rotation of the rotor is also stopped.

The degree to which the toner is pressed can be represented by a space ratio of the resultant toner layer. When measuring the torque, the space ratio (i.e., pressing degree) is very important. When the space ratio is not less than 0.4, the torque and load can be stably measured. In other words, the data of torque and load vary when the space ratio is less than 0.4 (40%). The space ratio is preferably from 0.4 (40%) to 0.7 (70%). When the space ratio is greater than 0.7 (70%), the toner is scattered and therefore the data of torque and load vary.

In the present application, the measurements are performed while changing the weight 26 to obtain the relationship (i.e., primary regression formula) between the space ratio and the torque. In the present application, the torque at the space ratio of 58% is used.

The torque of the toner is preferably from 1.0 mNm to 2.5 mNm. When the torque is too low, the fluidity of the toner is not proper, and the amount of the developer on the developing roller varies. Therefore, images with uneven density are produced. In contrast, when the torque is too high, the developer cannot be well agitated in the developing device. Therefore, the developing device tends to be clogged with the developer, and thereby abnormal images are formed.

2. Particle Diameter

The toner of the present invention has a volume average particle diameter of from 5 μm to 12 μm, and preferably from 6 μm to 10 μm.

The volume average particle diameter (Dv and particle diameter distribution of toner are measured with a method using an instrument such as COULTER COUNTER TA-II and COULTER MULTISIZER II from Beckman Coulter Inc. Specifically, the procedure is as follows:

(1) a surfactant serving as a dispersant (preferably 0.1 to 5 ml of a 1% aqueous solution of an alkylbenzenesulfonic acid salt), is added to 100 ml to 150 ml of an electrolyte such as 1% aqueous solution of first class NaCl or ISOTON-II manufactured by Beckman Coulter Inc.;

(2) 2 to 20 mg of a sample to be measured is added into the electrolyte including the surfactant;

(3) the mixture is subjected to an ultrasonic dispersion treatment for about 1 to 3 minutes to disperse the sample in the electrolyte; and (4) the volume-basis particle diameter distribution and number-basis particle diameter distribution of the sample are measured using the instrument in which the aperture is set to 100 μm to determine the volume average particle diameter (Dv) and number average particle diameter (Dn).

In the present invention, the following 13 channels are used:

(1) not less than 2.00 μm and less than 2.52 μm;
(2) not less than 2.52 μm and less than 3.17 μm;
(3) not less than 3.17 μm and less than 4.00 μm;
(4) not less than 4.00 μm and less than 5.04 μm;
(5) not less than 5.04 μm and less than 6.35 μm;
(6) not less than 6.35 μm and less than 8.00 μm;
(7) not less than 8.00 μm and less than 10.08 μm;
(8) not less than 10.08 μm and less than 12.70 μm;
(9) not less than 12.70 μm and less than 16.00 μm;
(10) not less than 16.00 μm and less than 20.20 μm;
(11) not less than 20.20 μm and less than 25.40 μm;
(12) not less than 25.40 μm and less than 32.00 μm; and
(13) not less than 32.00 μm and less than 40.30 μm.

Namely, particles having a particle diameter of from 2.00 μm to 40.30 μm are targeted.

3. Average Circularity of Toner

The toner of the present invention preferably has a large average circularity. In this case, images having a good combination of image density and reproducibility can be produced.

The circularity of a particle is determined by the following equation:

$$\text{Circularity}=L1/L2,$$

wherein L2 represents the length of the circumference of the projected image of a particle and L1 represents the length of the circumference of a circle having the same area as that of the projected image of the particle. The average circularity can be determined by averaging the circularities of a number of toner particles.

It is clear from the above-mentioned equation that the maximum average circularity is 1.00. In this case, the toner particles have a spherical shape.

In this application, the circularity of toner is measured with a flow-type particle image analyzer FPIA-2000 from Sysmex Corp. The procedure of the measurement is as follows.

(1) at first 100 ml to 150 ml of water from which solid foreign materials have been removed, 0.1 ml to 0.5 ml of a surfactant (preferably alkylbenzenesulfonic acid salts), which serves as a dispersant and 0.1 g to 0.5 g of a sample (i.e., toner) are mixed;

(2) the mixture is subjected to a supersonic dispersion treatment for 1 to 3 minutes using a supersonic dispersion machine to prepare a dispersion including particles of the sample at a concentration of from 3,000 to 10,000 pieces/μl;

(3) the dispersion is passed through a detection area formed on a plate in the instrument; and (4) the particles are optically detected by a CCD camera and then the shapes thereof are analyzed with an image analyzer, resulting in determination of the average circularity of the sample.

4. Adhesiveness of External Additive

The adhesiveness of the external additive (serving as a fluidizer) to the toner particles is determined as follows.

(1) two grams of a toner is pressed for 60 seconds at a pressure of 1 N/cm$^2$ to prepare a pellet of the toner, and the pellet is subjected to an analysis using a fluorescent X-ray analyzer (wavelength disperse fluorescent X-ray analyzer XRF1700 from Shimadzu Corp.) to determine the amount (Wb) of the external additive adhered to the toner particles by checking the amount of an element specific to the external additive (for example, the amount of silicon is determined when a silica is used as an external additive) using a working curve;

(2) two grams of the toner is mixed with 30 g of a 10% by weight aqueous solution of a surfactant;

(3) the mixture is agitated for 1 minute by a homogenizer while applying a power of 40 W to the homogenizer;

(4) the toner is separated from the surfactant solution, followed by washing and drying; and (5) the thus treated toner is also pelletized and analyzed using the fluorescent X-ray analyzer to determine the amount (Wa) of the external additive adhered to the toner particles after the agitation treatment.

The adhesiveness (A) of the external additive to the toner particles is represented by the following equation;

$$A=(Wa/Wb)\times 100(\%).$$

The adhesiveness is preferably from 30 to 80%. When the adhesiveness is too weak, the amount of the external additive fixed to the toner particles is small. Therefore, the free particles of the external additive influence image qualities, resulting in formation of abnormal images. In contrast, when the adhesiveness is too strong, the external additive tends to be embedded into the toner particles. Therefore, the fluidizing effect or spacer effect cannot be well produced, resulting in occurrence of the toner adhesion problem.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Toner Preparation Examples 1-8 and Comparative Examples 1-4 Preparation of First Binder Resin The following components were contained in a dropping funnel.

| Vinyl monomers | |
|---|---|
| Styrene | 600 g |
| Butyl acrylate | 110 g |
| Acrylic acid | 30 g |
| Dicumylperoxide (polymerization initiator) | 30 g |

The following components were contained in a four necked 5-liter flask equipped with a thermometer, a stainless stirrer, a condenser, and a nitrogen feed pipe.

| Monomers for polyester resin | |
|---|---|
| Polyoxypropylene(2.2)-2,2-bis(4-hydroxylphenyl)propane | 1230 g |
| Polyoxyethylene(2.2)-2,2-bis(4-hydroxylphenyl)propane | 290 g |
| Isododecenyl succinic anhydride | 250 g |
| Terephthalic acid | 310 g |
| 1,2,4-benzenetricarboxylic acid anhydride | 180 g |
| Dibutyl tin oxide (esterification catalyst) | 7 g |
| Paraffin wax (melting point: 73.3° C., half width of absorption peak in DSC curve: 4° C., weight ratio of monomers to wax: 100:4) | 120 g |

The components in the four-necked flask were heated to 160° C. by a mantle heater while agitated with the stirrer under a nitrogen gas flow. In addition, the components in the dropping funnel was dropped in the flask over one hour. After the mixture was heated for 2 hours at 160° C. to complete an addition polymerization reaction, the reaction product was heated to 230° C. to perform a polycondensation reaction. The polymerization degree of the reaction product was occasionally checked by measuring the softening point of the reaction product using a constant-pressure orifice rheometer. When the reaction product had a desired softening point, the polycondensation reaction was stopped. Thus, a resin H1 having a softening point of 130° C. was prepared.

Preparation of Second Binder Resin

The following components were contained in a four necked 5-liter flask equipped with a thermometer, a stainless stirrer, a condenser, and a nitrogen feed pipe.

| Monomers for polyester resin | |
|---|---|
| Polyoxypropylene(2.2)-2,2-bis(4-hydroxylphenyl)propane | 2210 g |
| Terephthalic acid | 850 g |
| 1,2,4-benzenetricarboxylic acid anhydride | 120 g |
| Dibutyl tin oxide (esterif ication catalyst) | 0.5 g |

The components in the four-necked flask were heated to 230° C. by a mantle heater while agitated with the stirrer under a nitrogen gas follow to perform a polycondensation reaction. The polymerization degree of the reaction product was occasionally checked by measuring the softening point of the reaction product using a constant-pressure orifice rheometer. When the reaction product had a desired softening point, the polycondensation reaction was stopped. Thus, a resin L1 having a softening point of 115° C. was prepared.

Preparation of Toner Particles

The following components were mixed with a HENSCHEL MIXER mixer.

| | |
|---|---|
| First binder resin (H1) | 75 parts |
| Second binder resin (L1) | 25 parts |
| C.I. Pigment Red 57-1 (which is added in form of pigment master batch) | 4 parts |

The mixture was then melted and kneaded with a double-axis extrusion kneader, PCM-30 from Ikegai Corporation. In this melting and kneading process, the temperature and pressure were changed to change the distribution of the wax in the kneaded mixture, i.e., to change the amount of wax present on the surface of the resultant toner particles (i.e., the amount of exposed wax).

The kneaded mixture was then cooled by a cooling press roller so as to have a thickness of 2 mm, followed by cooling with a cooling belt. After the cooled mixture was crushed with a feather mill, the particles were pulverized with a mechanical pulverizer KTM from Kawasaki Heavy Industries, Ltd. so as to have an average particle diameter of from 10 to 12 μm, followed by pulverization with a jet pulverizer IDS from Nippon Pneumatic Mfg. Co., Ltd. while being subjected to a coarse particle classification. The pulverized mixture was then subjected to a fine particle classification using a rotor classifier TURBOPLEX 100 ATP from Hosokawa Micron Corp. to prepare a colored particulate material (i.e., toner particles).

One hundred (100) parts of the thus prepared colored particulate material was mixed with 3.5 parts of a particulate silica CABOSIL TS530 from Cabot Corp. In this case, a HENSCHEL MIXER mixer (from Mitsui Miike Machinery Co., Ltd.) was used for mixing. Thus, magenta toners for use in Examples 1-8 and Comparative Examples 1-4 were prepared. The formulae and properties of the toners are shown in Tables 1 and 2 below.

Comparative Example 5

Preparation of Polar Polymer

In a vessel equipped with a condenser, an agitator, a thermometer, a nitrogen feed pipe, a dropping device and a decompression device, the following components were mixed.

| | |
|---|---|
| Methanol | 150 parts |
| 2-Butanone | 250 parts |
| 2-Propanol | 100 parts |
| Styrene | 84 parts |
| 2-Ethylhexyl acrylate | 13 parts |
| 2-Acrylamide-2-methylpropane sulfonic acid (i.e., AMPS) | 3 parts |

The mixture was heated to a reflux temperature while agitated.

Next, a solution of an initiator, which had been prepared by dissolving 2 parts of t-butylperoxy-isobutyrate in 20 parts of 2-butanone, was dropped thereinto over 30 minutes, and the mixture was agitated for 5 hours. Further, a solution of the initiator, which had been prepared by dissolving 1 part of t-butylperoxy-isobutyrate in 20 parts of 2-butanone, was dropped thereinto over 30 minutes, and the mixture was agitated for 5 hours. Thus, polymerization was completed.

After the solvents in the thus prepared polymer solution were removed under a reduced pressure, the resultant polymer was coarsely pulverized with a cutter mill equipped with a screen having openings of 100 μm. Thus, particles of a polar polymer (1) having particle diameters of not greater than 100 μm were prepared.

Preparation of Toner

In a 2-litter four-necked flask equipped with a high speed agitator (i.e., TK-HOMOMIXER from Tokushu Kika Kogyo Co., Ltd.), the following components were mixed and agitated by the agitator whose rotor was rotated at a revolution of 12,000 rpm while heated to 60° C.

| | |
|---|---|
| Ion-exchange water | 910 parts |
| Polyvinyl alcohol | 1 part |

Thus a polyvinyl alcohol solution serving as a dispersion medium was prepared.

The following components were mixed.

| | |
|---|---|
| Styrene | 165 parts |
| n-Butyl acrylate | 35 parts |
| Phthalocyanine pigment (C.I. Pigment Blue 15:3) | 10 parts |
| Polyester resin (Polycondensation product of polypropylene oxide-modified bisphenol A and isophthalic acid, having weight average molecular weight (Mw) of 10,000, number average molecular weight (Mn) of 6,000, and glass transition temperature of 70° C.) | 30 parts |
| Polar polymer (1) prepared above | 2 parts |
| Al-containing salicylic acid compound (BONTRON E-88 from Orient Chemical Industries Co., Ltd.) | 4 parts |
| Divinyl benzene | 0.2 parts |
| Stearyl stearate (wax) (having a thermal property such that the main peak is observed at 60° C. when the material is subjected to differential scanning calorimetry (DSC)) | 30 parts |

After the mixture was dispersed for 3 hours using an attritor, 5 parts of a polymerization initiator, 2,2'-azobis(2,4-dimethylvaleronitril) was added to the dispersion to prepare a toner composition liquid.

The thus prepared toner composition liquid was added to the above-prepared dispersion medium. The mixture was agitated for 12 minutes to prepare a dispersion. The dispersion was further agitated for 10 hours with an agitator having a propeller rotated at a revolution of 50 rpm while heated to 65° C. Thus, polymerization was completed. After the polymerization, the reaction product was cooled, and the resultant colored particles were washed with water, followed by drying. The colored particles were then classified with a classifier utilizing a Coanda effect to control the particle diameter.

Thus, a cyan toner of Comparative Example 5 was prepared.

Each of the thus prepared toners was evaluated with respect to the following properties.

1. Volume Average Particle Diameter (Dv)

The volume average particle diameter (Dv) of the toner was determined by the method mentioned above.

2. Average Circularity (CIR)

The volume average particle diameter (Dv) of the toner was determined by the method mentioned above.

3. Fluidity (Torque)

The torque of the toner was determined by the method mentioned above. In this regard, the space ratio was also measured.

4. Evaluation Using Laser Color Printer (1) Unevenness of Image Density

Each toner was set in a laser color printer, IPSIO CX3000 from Ricoh Co., Ltd., and one thousand (1,000) images including a solid image were produced. After the running test, the weights of toner at several portions of the solid toner image were measured to determine whether or not the weight varies, i.e., the solid image has uneven image density (caused by supply of excessive amount of developer). In this regard, the distance |a−b| was changed.

The unevenness of image density was graded as follows.

○: The image density of the solid image is even.

X: The image density of the solid image is uneven.

(2) Streak Image

The above-mentioned image produced after the running test was visually observed to determine whether or not the solid image has a streak image caused by adhesion of the toner to the developer layer forming blade.

The image was graded as follows concerning the property (streak image).

○: The solid image has no white streak.

X: The solid image has one or more wide white streaks.

(3) Feedability of Developer

Similarly to the method for evaluating the unevenness of image density, the solid image produced after the running test was carefully observed to determine whether or not the rear end portion of the solid image has a low image density caused by insufficient amount of developer. In this regard, the distance |a−b| was changed.

The feedability of the developer was graded as follows.

○: The image density of the rear end portion of the solid image is almost the same as that of the other portions of the solid image.

X: The image density of the rear end portion of the solid image is lower than that of the other portions of the solid image, and the image is not acceptable.

The added amounts of the wax and external additive when preparing the toners are illustrated in Table 1. In addition, the distance |a−b| is also illustrated in Table 1.

The evaluation results of the toner are shown in Table 2.

TABLE 1

| | Added amount of wax (parts by weight) | Added amount of external additive (parts by weight) | Distance \|a-b\| (mm) |
|---|---|---|---|
| Ex. 1 | 6 | 3 | 0.8 |
| Ex. 2 | 6 | 3 | 1.2 |
| Ex. 3 | 6 | 3 | 1.8 |
| Ex. 4 | 6 | 3 | 2.0 |
| Ex. 5 | 6 | 3 | 0.8 |
| Ex. 6 | 6 | 3 | 1.2 |
| Ex. 7 | 6 | 3 | 1.8 |
| Ex. 8 | 6 | 3 | 2.0 |
| Comp. Ex. 1 | 6 | 3 | 0.6 |
| Comp. Ex. 2 | 6 | 3 | 2.1 |
| Comp. Ex. 3 | 6 | 3 | 0.6 |
| Comp. Ex. 4 | 6 | 3 | 2.1 |
| Comp. Ex. 5 | 6 | 3 | 1.0 |

TABLE 2

| | Properties of toner | | | | Image qualities | | |
|---|---|---|---|---|---|---|---|
| | Dv (μm) | CIR* | Torque (mNm) | Space ratio (%) | Feed-ability | Streak image | Uneven-ness of image density |
| Ex. 1 | 9.5 | 0.919 | 1.0 | 58 | ○ | ○ | ○ |
| Ex. 2 | 9.5 | 0.919 | 1.0 | 58 | ○ | ○ | ○ |
| Ex. 3 | 9.5 | 0.919 | 1.0 | 58 | ○ | ○ | ○ |
| Ex. 4 | 9.5 | 0.919 | 1.0 | 58 | ○ | ○ | ○ |
| Ex. 5 | 6.5 | 0.919 | 2.4 | 57 | ○ | ○ | ○ |
| Ex. 6 | 6.5 | 0.919 | 2.4 | 57 | ○ | ○ | ○ |
| Ex. 7 | 6.5 | 0.919 | 2.4 | 57 | ○ | ○ | ○ |
| Ex. 8 | 6.5 | 0.919 | 2.4 | 57 | ○ | ○ | ○ |
| Comp. Ex. 1 | 9.5 | 0.919 | 1.0 | 58 | ○ | X | X |
| Comp. Ex. 2 | 9.5 | 0.919 | 1.0 | 58 | X | X | ○ |
| Comp. Ex. 3 | 6.5 | 0.919 | 2.4 | 57 | ○ | X | X |
| Comp. Ex. 4 | 6.5 | 0.919 | 2.4 | 57 | X | X | ○ |
| Comp. Ex. 5 | 7.5 | 0.980 | 1.2 | 57 | ○ | ○ | X |

CIR*: Average circularity
VARI**: Variation in amount of toner on developing roller It is clear from Table 2 that the images produced in Examples 1-8 are superior in image qualities (such as evenness, streak images), and any problems concerning feeding of toner are not caused. In contrast, the images produced in Comparative Examples 1-5 cause at least one of the problems concerning the image qualities and toner feedability.

Additional modifications and variations of the present invention are possible in light of the above teachings. It is therefore to be understood that within the scope of the appended claims the invention may be practiced other than as specifically described herein.

This document claims priority and contains subject matter related to Japanese Patent Application No. 2007-071534, filed on Mar. 19, 2007, the entire contents of which are herein incorporated by reference.

What is claimed is:

1. A developing device comprising:

a developer hearing member configured to feed a developer to an image bearing member while rotating and bearing a layer of the developer thereon to develop an electrostatic latent image on the image bearing member therewith;

a developer supplying member, which is contacted with the developer bearing member at a first nip while opposed thereto and which rotates to supply the developer to the developer hearing member;

a developer layer forming member, which is contacted with the developer bearing member at a second nip located on a downstream side from the first nip relative to a rotation direction of the developer bearing member to form the layer of the developer on the developer bearing member; and a developer supplying mechanism located over the developer supplying member and the developer bearing member to supply the developer to the developer supplying member, wherein the developer is a nonmagnetic one component developer, wherein a front edge of the second nip and a rear edge of the first nip relative to the rotation direction of the developer bearing member are disposed at locations a and b, respectively, such that $0.8\ mm<|a-b|<2.0\ mm$, wherein $|a-b|$ represents a distance between the location a of said front edge of the second nip and the location b of said rear edge of the first nip relative to the rotation direction of the developer bearing member.

2. The developing device according to claim 1, wherein a rotation direction of the developer supplying member is the same as the rotation direction of the developer bearing member, and at the first nip the developer supplying member and the developer bearing member move in opposite directions.

3. The developing device according to claim 1, wherein the developer layer forming member is contacted with the developer bearing member with the developer therebetween, and wherein a portion other than a tip of the developer layer forming member is contacted with the developer bearing member.

4. The developing device according to claim 3, wherein the developer layer forming member is a blade, and wherein a distance between the front edge of the second nip and the tip of the developer layer forming member is from 0.1 mm to 2 mm.

5. The developing device according to claim 3, wherein the developer layer forming member is a blade, and wherein the tip of the developer layer forming member extends toward the first nip.

6. The developing device according to claim 1, wherein the developer includes a binder resin, a wax, a colorant, and an external additive, and wherein the developer has a volume average particle diameter of from 6 μm to 10 μm.

7. The developing device according to claim 6, wherein the external additive is included in the developer in an amount of from 2.5 parts to 4.0 parts by weight per 100 parts by weight of the developer.

8. The developing device according to claim 6, wherein the external additive has an average primary particle diameter of from 10 nm to 50 nm.

9. The developing device according to claim 6, wherein the external additive is a silica, and wherein the silica is adhered to the toner at an adhesiveness of from 30% to 80%.

10. The developing device according to claim 6, wherein the wax is included in the developer in an amount of from 3 parts to 10 parts by weight per 100 parts by weight of the developer.

11. The developing device according to claim 6, wherein the wax is substantially included in the binder resin.

12. An image forming method comprising:

supplying a nonmagnetic one component developer to a developer hearing member with a developer supplying member, wherein the developer supplying member is contacted with the developer bearing member at a first nip;

forming a layer of the nonmagnetic one component developer on a developer bearing member with a developer layer forming member, wherein the developer layer forming member is contacted with the developer bearing member at a second nip; and developing an electrostatic image on an image bearing member with the developer layer formed on the developer bearing member to form a toner image on the image bearing member, wherein a front edge of the second nip and a rear edge of the first nip relative to a rotation direction of the developer bearing member are disposed at locations a and b, respectively, such that $0.8\ mm<|a-b|<2.0\ mm$, wherein $|a-b|$ represents a distance between the location a of said front edge of the second nip and the location b of said rear edge of the first nip relative to the rotation direction of the developer bearing member.

13. An image forming apparatus comprising:

an image bearing member configured to bear an electrostatic image;

the developing device according to claim 1, which develops the electrostatic image to form a toner image on the image bearing member;

a transfer device configured to transfer the toner image to a receiving material optionally via an intermediate transfer medium; and a fixing device configured to fix the toner image on the receiving material, wherein the fixing device includes a heat roller and a pressure roller, the heat roller and pressure roller sandwiching the toner image to fix the toner image to the receiving material.

14. The image forming apparatus according to claim 13, wherein the fixing device does not include an oil applicator configured to apply an oil to the heat roller.

15. A process cartridge comprising:

an image hearing member configured to bear an electrostatic image; and the developing device according to claim 1, which develops the electrostatic image to form a toner image on the image bearing member, wherein the process cartridge is detachably attached to an image bearing member as a unit.

* * * * *